US010434637B2

(12) United States Patent
Sites

(10) Patent No.: US 10,434,637 B2
(45) Date of Patent: Oct. 8, 2019

(54) TOOL ORGANIZER AND TRANSPORT

(71) Applicant: Paul S. Sites, Atlanta, GA (US)

(72) Inventor: Paul S. Sites, Atlanta, GA (US)

( * ) Notice: Subject to any disclaimer, the term of this patent is extended or adjusted under 35 U.S.C. 154(b) by 520 days.

(21) Appl. No.: 15/213,590

(22) Filed: Jul. 19, 2016

(65) Prior Publication Data

US 2018/0021938 A1 Jan. 25, 2018

(51) Int. Cl.
*B25H 3/00* (2006.01)

(52) U.S. Cl.
CPC ..... *B25H 3/00* (2013.01)

(58) Field of Classification Search
CPC ... B25H 3/00; B25H 3/04; B44D 3/12; B44D 3/121
USPC ..... 206/372, 373; 220/735
See application file for complete search history.

(56) References Cited

U.S. PATENT DOCUMENTS 4,362,243 A 12/1982 Deyesso et al.
4,627,595 A * 12/1986 Rhodes ..... F25C 1/243 220/506
4,826,007 A 5/1989 Skeie
4,867,332 A 9/1989 Mains
5,350,065 A 9/1994 Darrey
D372,125 S 7/1996 Frazier
5,540,329 A 7/1996 Vogeley
5,924,568 A 7/1999 Zajonc
8,127,965 B1 3/2012 Miller
8,636,291 B1 1/2014 Kay
8,662,300 B1 3/2014 Arena
2009/0261012 A1* 10/2009 Griot ..... G01F 19/00 206/459.5
2013/0037559 A1 2/2013 Fierek

* cited by examiner

*Primary Examiner* — King M Chu
(74) *Attorney, Agent, or Firm* — Asgaard Patent Services, LLC; F. Wayne Thompson, Jr.

(57) ABSTRACT

Implementations of a tool organizer and transport are provided. In some implementations, the tool organizer and transport may be configured to provide a water proof enclosure in which tools may be stored and transported. In some implementations, the tool organizer and transport may be comprised of a bucket, a lid, a handle, and a tool container insert. In some implementations, the tool container insert may include a number of pouches and be configured to removably fit within the interior space of the bucket. In this way, tools may be removably stored within the bucket. In some implementations, there is additional tool storage space located between the bottom of the tool container insert and the bottom face of the bucket. In some implementations, the annular rim of the tool container insert may be one or more colors and thereby used to organize the placement of tools into adjacently positioned pouches.

12 Claims, 6 Drawing Sheets

TOOL ORGANIZER AND TRANSPORT

TECHNICAL FIELD

This disclosure relates to implementations of a tool organizer and transport, and more particularly to a tool carrier insert configured for use with a bucket.

BACKGROUND

Buckets are routinely used by tradesmen and handymen to carry tools, fasteners, and/or other frequently used implements. Five-gallon buckets are frequently used to transport tools because there size is ideal for carrying a variety of larger tools such as hammers and large wrenches.

There are problems inherent to carrying tools in a bucket such as tool access. When tools are placed in a bucket they pile up and intertangle therein. This makes it difficult to locate and extract any single specific tool, fastener, and/or other frequently used implement. Often, the bucket may need to be dumped in order for a tool, especially a small tool, to be located.

U.S. Pat. No. 5,350,065 ("'065 patent") discloses a tool bucket organizer designed to store and organize small hand tools within a bucket. The '065 patent teaches that the tool bucket organizer is an insert comprised of two discs having a slightly smaller diameter than the interior diameter of a bucket. Each disc is provided with multiple holes and slots to hold various hand tools and the insert is held off the bottom of the bucket by a set of legs.

However, the tool bucket organizer disclosed in the '065 patent has several disadvantages. First, the tool bucket organizer is not designed to be removable and transported while tools are stored therein. Second, no space is provided to store tools too large to fit within the holes and slots of the insert. Third, because the holes and slots of the insert are in fixed positions, the tool bucket organizer offers little flexibility in regards to the placement and/or variety of tools that it can accommodate. Fourth, large tools may not be stored on the bottom of the bucket because the legs are designed to rest thereon.

SUMMARY OF THE INVENTION

Implementations of a tool organizer and transport are provided. In some implementations, the tool organizer and transport may be configured to provide a water proof enclosure in which tools, fasteners, and/or other frequently used implements may be stored and transported. In some implementations, the tool organizer and transport may be configured to organize tools, fasteners, and/or other frequently used implements.

In some implementations, the tool organizer and transport may be comprised of a bucket, a lid, a handle, and a tool container insert. In some implementations, the tool container insert may be configured to removably fit within the interior space of the bucket. In this way, tools, fasteners, and/or other frequently used implements may be removably stored within the bucket. In some implementations, there is a storage space located between the bottom of the tool container insert and the bottom face of the bucket. In this way, additional tools, fasteners, and/or other frequently used implements not stored within the tool container insert may be stored within the bucket. In some implementations, the annular rim of the tool container insert may have one or more colors thereon that are used to organize the placement of tools, fasteners, and/or other frequently used implements into adjacently positioned pouches.

In some implementations, the tool container insert may be comprised of a body portion having a flexible and/or retractable handle. In some implementations, the body portion of the tool container insert may comprise a bottom having a cylindrical side wall extending upwardly therefrom, three interior pockets, and three exterior pockets. In some implementations, the cylindrical side wall may have an annular rim on a top side thereof. In some implementations, the tool container insert may be configured to contour to the interior side of the cylindrical side wall of the bucket.

In some implementations, the annular rim of the tool container insert may be one or more colors. In some implementations, portion(s) or lengths of the annular rim adjacent each of the interior pockets may be a unique color. The user may then associate each color of the annular rim with one or more types of tool, fastener, and/or other frequently used implement to be stored within a particular interior pocket.

DETAILED DESCRIPTION

Figure 1A:
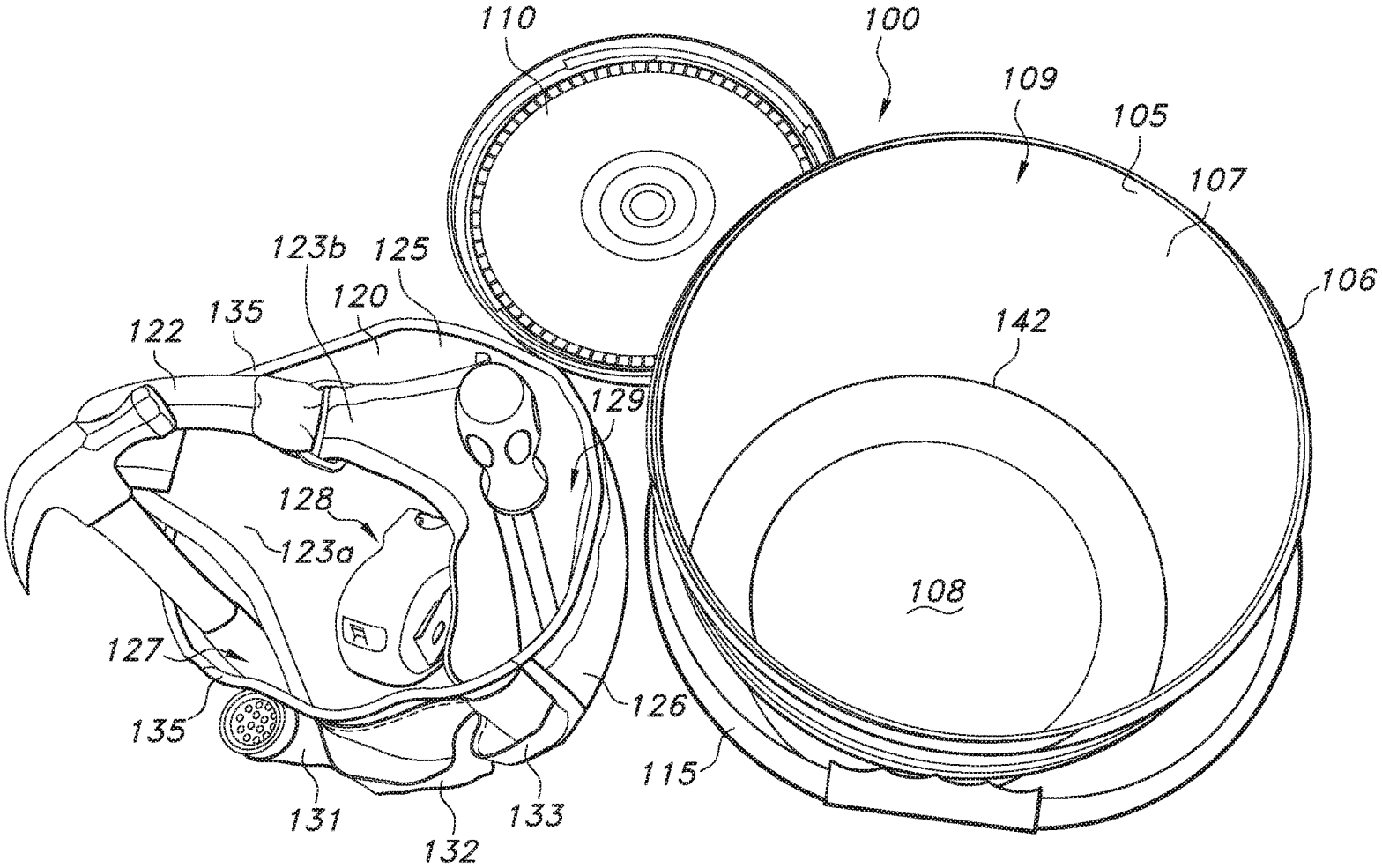
FIGS. 1A-1C illustrate an example implementation of a tool organizer and transport according to the principles of the present disclosure.
Figure 1B:
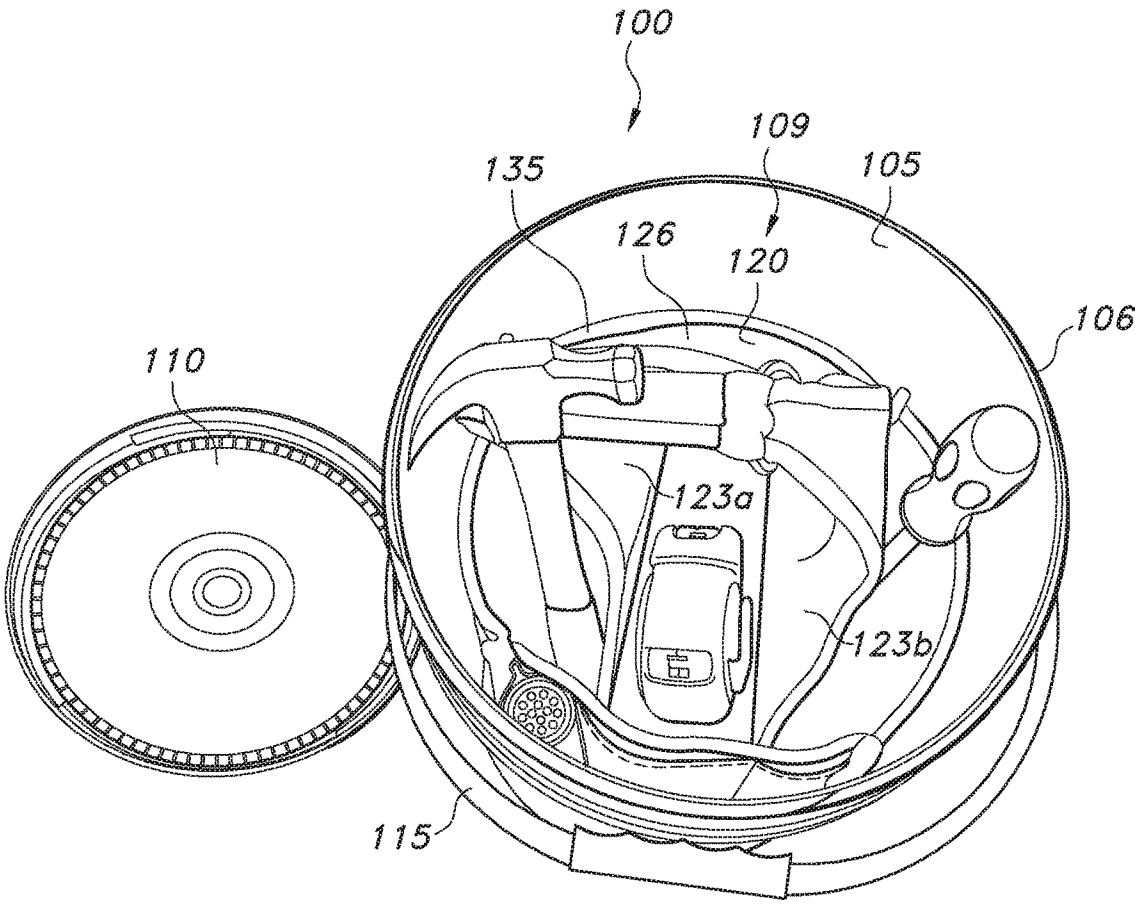
Figure 1C:
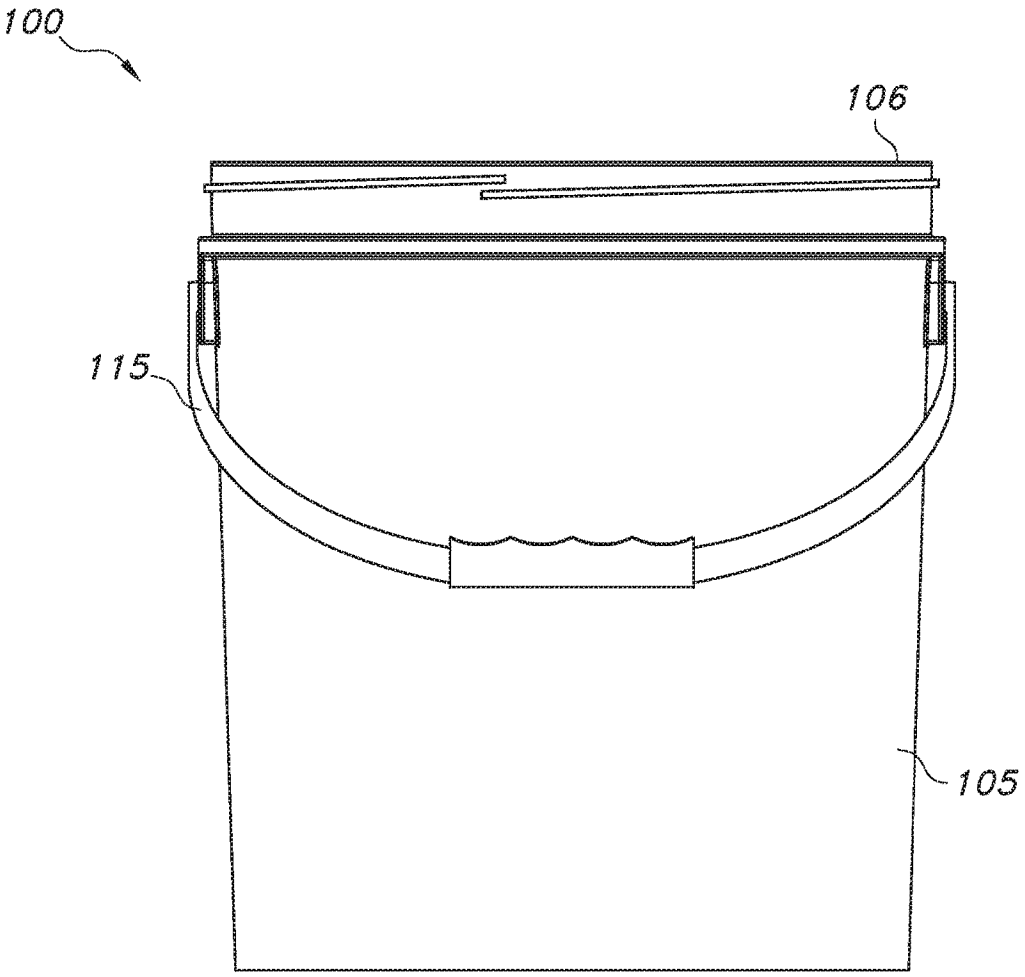

FIGS. 1A-1C illustrate an example implementation of a tool organizer and transport 100 according to the principles of the present disclosure. In some implementations, the tool organizer and transport 100 may be configured to provide a water proof enclosure in which tools, fasteners, and/or other frequently used implements may be stored and transported. In some implementations, the tool organizer and transport 100 may be configured to organize tools, fasteners, and/or other frequently used implements.

As shown in FIG. 1A, in some implementations, the tool organizer and transport 100 may be comprised of a bucket 105, a lid 110, a handle 115, and a tool container insert 120. In some implementations, the tool container insert 120 may be configured to removably fit within the interior space 109 of the bucket 105 (see, e.g., FIG. 1B). In this way, tools, fasteners, and/or other frequently used implements may be removably stored within the bucket 105. In some implementations, there may be a storage space 140 located between the bottom 121 of the tool container insert 120 and the bottom face 108 of the bucket 105 (see, e.g., FIG. 3). In this way, additional tools, fasteners, and/or other frequently used implements not stored within the tool container insert 120 may be stored within the bucket 105. In some implementations, the annular rim 135 (discussed in detail below) of the tool container insert 120 may be one or more colors and used to organize the placement of tools, fasteners, and/or other frequently used implements into adjacently positioned pouches (see, e.g., FIG. 2B).

In some implementations, the bucket 105 may have a circular bottom. In some implementations, the bucket 105 may include a cylindrical side wall 107 integrally coupled to the bottom face 108 that extends upwardly therefrom. In this way, an interior space 109 and an open top 106 are defined (see, e.g., FIG. 1B).

Figure 3:
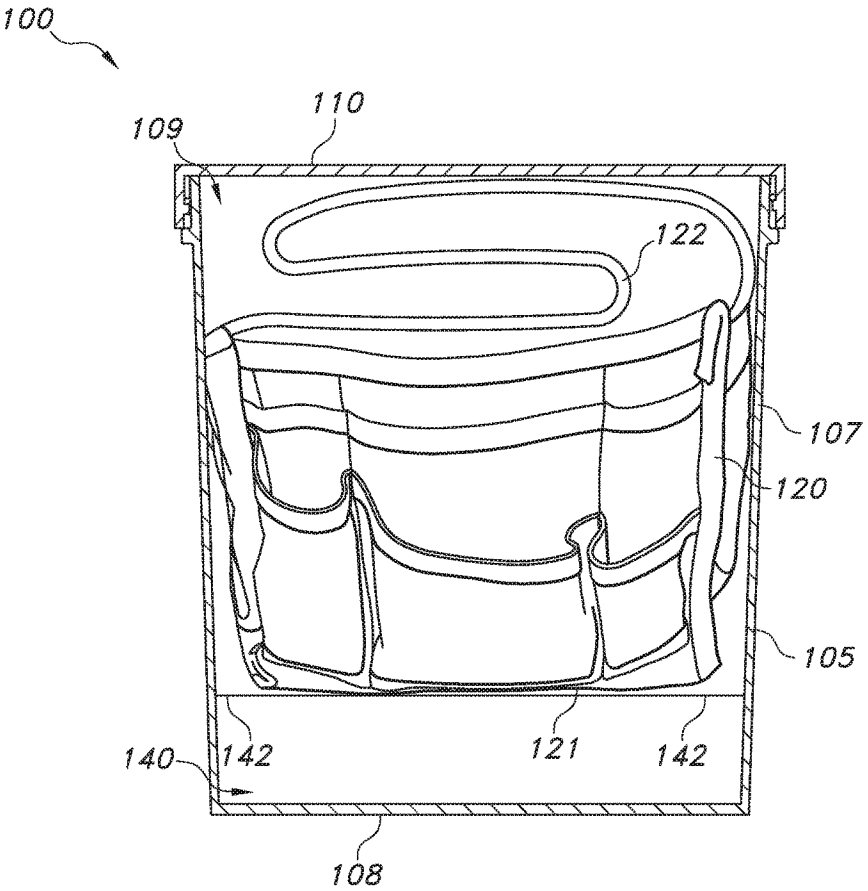
FIG. 3 illustrates a side cutaway of the tool organizer and transport shown in FIG. 1C.

In some implementations, an indicator line 142, or other similar mark, may be positioned on the interior side of the cylindrical side wall 107 of the bucket 105 (see, e.g., FIG. 3). In some implementations, the indicator line 142 may extend horizontally about the interior side of the cylindrical side wall 107. In some implementations, the indicator line 142 may be comprised of two or more non-overlapping lines extending horizontally, on the same plane, about the interior side of the cylindrical side wall 107. In some implementations, the indicator line 142 may be an indentation and/or impression into the interior side of the cylindrical side wall 107. In some implementations, the indicator line 142 may be molded into the interior side of the cylindrical side wall 107. In some implementations, the indicator line 142 may be a mark and/or sticker positioned on the interior side of the cylindrical side wall 107. In some implementations, the indicator line 142 may be one or more colors. In some implementations, the indicator line 142 serves to designate the top edge of the storage space 140.

As shown in FIG. 3, in some implementations, the storage space 140 lies between the indicator line 142 and the bottom face 108 of the bucket 105. In some implementations, the indicator line 142 is positioned on the interior side of the cylindrical side wall 107 to indicate how much of the interior space 109 may be used as storage space 140. In this way, the indicator line 142 acts as a fill line so the user knows how much of the interior space 109 may be used to store tools, fasteners, and/or other frequently used implements without preventing the tool container insert 120 from being placed within the bucket 105 and the lid 110 being secured to the top 106 of the bucket 105.

As shown in FIG. 1C, in some implementations, the lid 110 may be configured to secure about the top 106 of the bucket 105 and thereby enclose the interior space 109 thereof. In this way, the contents of the bucket 105 may be protected from the elements (e.g., water). In some implementations, the lid 110 may be a screw-on type lid and the bucket 105 may have threads configured to interface with the lid 110 on its exterior, near the top 106 of the side wall 107 (see, e.g., FIGS. 1A and 1C). In some implementations, the lid 110 may be a press-fit type lid.

In some implementations, the lid 110 may be secured to the tool organizer and transport 100 by a locking device such as a padlock. In some implementations, the lid 110 and the bucket 105 may each have a loop extending therefrom (not shown). In some implementations, the loop extending from the lid 110 may be configured to align with the loop extending from the bucket 105 when the lid 110 is secured thereto. In this way, the shackle of a padlock may be inserted through the aligned openings of the loops thereby securing the lid 110 to the bucket 105.

As shown in FIG. 1A, in some implementations, the bucket 105 may have a handle 115 secured thereto. In this way, the handle 115 may be grasped by a user and used to transport the tool organizer and transport 100.

Figure 2A:
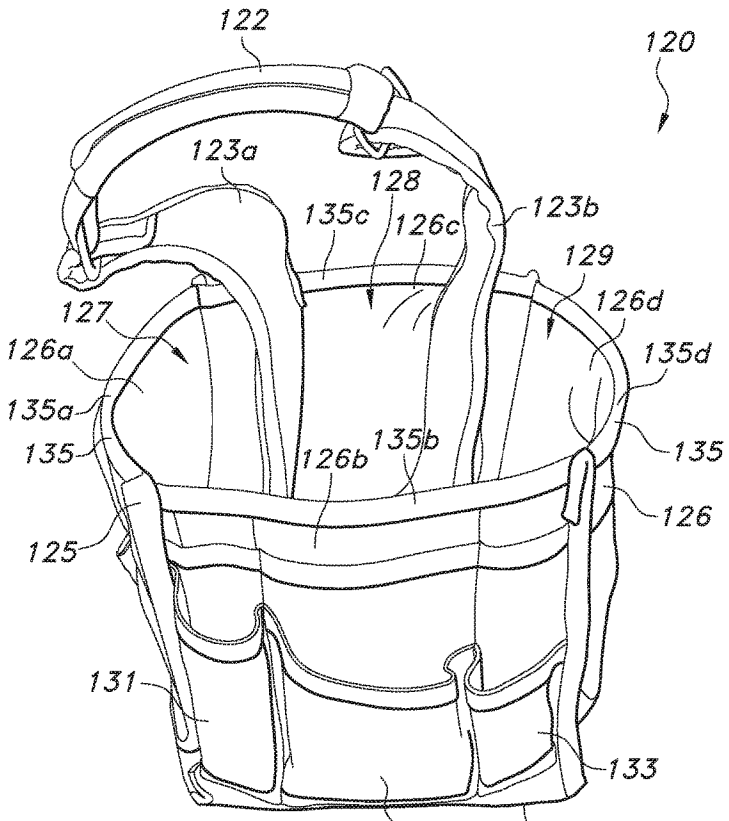
FIGS. 2A-2B illustrate an example implementation of a tool carrier insert according to the principles of the present disclosure.
Figure 2B:
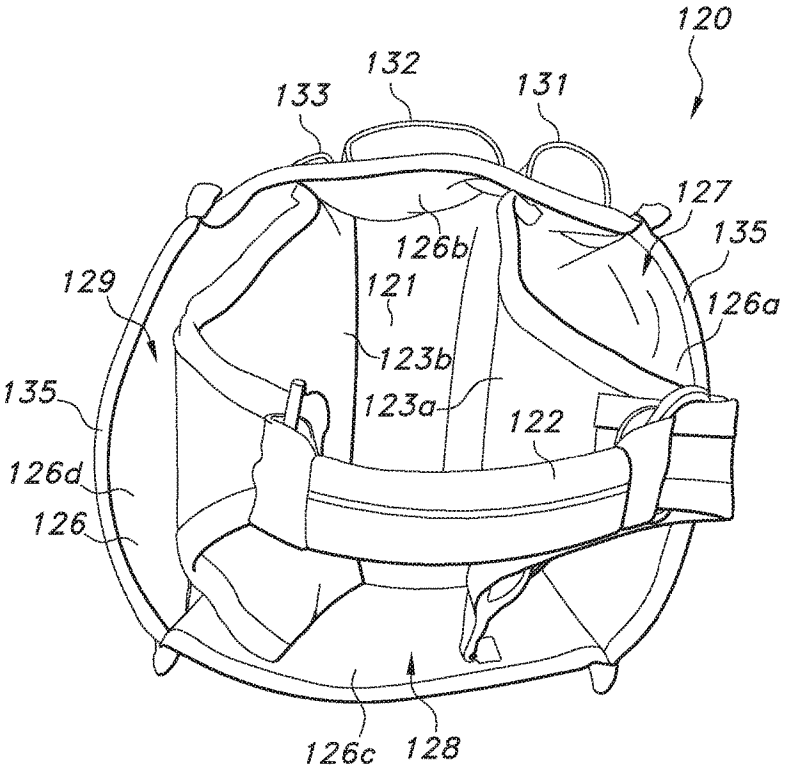

As shown in FIGS. 2A-2B, in some implementations, the tool container insert 120 may be comprised of a body portion 125 having a handle 122. In some implementations, the body portion 125 may comprise a bottom 121 having a cylindrical side wall 126 extending upwardly therefrom, three interior pockets (127, 128, 129), and three exterior pockets (131, 132, 133) (see, e.g., FIG. 2B). In some implementations, the cylindrical side wall 126 may include an annular rim 135 on a top side thereof (see, e.g., FIG. 2B). In some implementations, the tool container insert 120 may be configured to contour to the interior side of the cylindrical side wall 107 of the bucket 105 (see, e.g., FIG. 2). In some implementations, the tool container insert 120 may not contour to the interior side of the cylindrical side wall 107 of the bucket 105.

In some implementations, the handle 122 is configured so that a user may lift the tool container insert 120 from the interior space 109 of the bucket 105. In this way, the tool container insert 120 may be transported by the user and the storage space 140 of the bucket 105 made accessible for use. In some implementations, the handle 122 may be configured so that a user may lower the tool container insert 120 into the interior space 109 of the bucket 105. In this way, the tool container insert 120 is stored within the bucket 105 and the movement of any tools in the storage space 140 minimized or eliminated as a result of the tool container insert 120 resting thereon.

As shown in FIG. 2A, in some implementations, the handle 122 of the tool container insert 120 may extend between a first interior side wall 123*a* and a second interior side wall 123*b* (collectively side walls 123) of the body portion 125. In some implementations, each of the side walls 123 extend between opposing portions of the cylindrical side wall 126 of the body portion 125 (see, e.g., FIG. 2B). In some implementations, the handle 122 of the tool container insert 120 may extend between opposing sides of the cylindrical side wall 126 (not shown).

As shown in FIG. 2B, in some implementations, the interior pockets (127, 128, 129) are located within the confines of the cylindrical side wall 126 of the tool container insert 120. In some implementations, the first interior pocket 127 lies between a first portion 126*a* of the side wall 126 and the first interior side wall 123*a* (see, e.g., FIG. 2B). In some implementations, the second interior pocket 128 lies between the first interior side wall 123*a*, the second interior side wall 123*b*, a second portion 126*b* of the side wall 126, and a third portion 126*c* of the side wall 126 (see, e.g., FIG. 2B). In some implementations, the third interior pocket 129 lies between a fourth portion 126*d* of the side wall 126 and the second interior side wall 123*a* (see, e.g., FIG. 2B).

As shown in FIG. 2A, in some implementations, the exterior pockets (131, 132, 133) of the body portion 125 may be secured to the exterior of the cylindrical side wall 126.

As shown in FIG. 1A, in some implementations, the interior pockets (127, 128, 129) and/or exterior pockets (131, 132, 133) may be configured to receive and contain therein one or more tools, fasteners, and/or other frequently used implements. In some implementations, the interior pockets (127, 128, 129) and/or exterior pockets (131, 132, 133) may further include dividers and/or additional pockets to further organize the space provided thereby. In some implementations, the interior pockets (127, 128, 129) and/or exterior pockets (131, 132, 133) may include a closable cover (not shown). In this way, objects stored within the pockets may be prevented from spilling out during transport. In some implementations, there may be more than three or less than three interior pockets and/or exterior pockets.

As shown in FIG. 2B, in some implementations, the annular rim 135 of the body portion 125 may be one or more colors. In some implementations, portion(s) (135*a*, 135*b*, 135*c*, 135*d*) or lengths of the annular rim 135 adjacent each of the interior pockets (127, 128, 129) may each be a unique color. In this way, the color of the annular rim 135 may be used to organize the tool container insert 120. For example, the portion 135*a* of the annular rim 135 adjacent the first interior pocket 127 may be a first color, the two portions

135*b*, 135*c* of the annular rim 135 adjacent the second interior pocket 128 may be a second color, and the portion 135*d* of the annular rim 135 adjacent the third interior pocket 129 may be a third color (see, e.g., FIG. 2A). The user may then associate each color of the annular rim 135, for example, with one or more types of tools, fasteners, and/or other frequently used implement to be stored within a particular interior pocket (127, 128, 129).

In some implementations, the tool carrier insert 120 may be manufactured from a wear-resistant fabric or cloth material such as canvas or nylon. In some implementations, the tool carrier insert 120 may be manufactured from any synthetic, semi-synthetic, or natural fiber, or combination thereof, suitable for use as part of a tool carrier insert 120.

In some implementations, the annular rim 135 of the tool carrier insert 120 may be manufactured from a wear-resistant fabric or cloth material such as canvas or nylon. In some implementations, the annular rim 135 of the tool carrier insert 120 may be manufactured from any synthetic, semi-synthetic, or natural fiber, or combination thereof, suitable for use as part of an annular rim 135 for a tool carrier insert 120. In some implementations, the annular rim 135 may be removably secured to a top side of the cylindrical side wall 126 of the tool carrier insert 120. In some implementations, the annular rim 135 may not be removably secured to a top side of the cylindrical side wall 126 of the tool carrier insert 120.

In some implementations, the annular rim 135 may include any visible color thereon. In some implementations, the one or more colors of the annular rim 135 may be primary colors (e.g., red, yellow, blue) or other colors generated by the additive mixing of the primary colors.

To use the tool organizer and transport 100, in some implementations, the user may initially associate a first, a second, and a third tool type (e.g., hammers, wrenches, pliers, fasteners, etc.) with the first, second, and third color, respectively, found on the annular rim 135 of the tool container insert 120.

Then, in some implementations, a first tool type (e.g., hammer) associated by the user with the first color of a portion 135*a* of the annular rim 135 may be placed into the first interior pocket 127 (see, e.g., FIGS. 1B and 2A). Next, a second tool type (e.g., a measuring tape) associated by the user with the second color of two portions 135*b*, 135*c* of the annular rim 135 may be placed into the second interior pocket 128 (see, e.g., FIGS. 1B and 2A). Then, a third tool type (e.g., a screw driver), associated by the user with the third color of a portion 135*d* of the annular rim 135 may be placed into the third interior pocket 129 (see, e.g., FIGS. 1B and 2A). In some implementations, more than one tool may be stored in each of the interior pockets (127, 128, 129).

Next, in some implementations, the user may grasp the handle 122 and place the tool container insert 120 through the open top 106 and into the interior space 109 of the bucket 105. Then, in some implementations, the lid 110 may be secured to the top 106 of the bucket.

Initially, in some implementations, the user may place tools too large and/or awkwardly shaped to fit into the tool container insert 120 into the storage space 140 of the bucket 105 up to the indicator line 142 on the interior side of the cylindrical side wall 107. This step may be taken prior to the placement of the tool container insert 120 into the bucket 105 or at any other appropriate time.

While a five-gallon bucket is specifically mentioned herein and shown in the appended drawings, it is to be understood that any similarly shaped bucket (two-gallon, 3.5 gallon, etc.) may be used as part of the tool organizer and transport 100 disclosed herein.

Reference throughout this specification to "an embodiment" or "an implementation" or words of similar import means that a particular described feature, structure, or characteristic is included in at least one embodiment of the present invention. Thus, the phrase "in an embodiment" or "an implementation" or a phrase of similar import in various places throughout this specification does not necessarily refer to the same embodiment.

Many modifications and other embodiments of the inventions set forth herein will come to mind to one skilled in the art to which these inventions pertain having the benefit of the teachings presented in the foregoing descriptions and the associated drawings.

The described features, structures, or characteristics may be combined in any suitable manner in one or more embodiments. In the above description, numerous specific details are provided for a thorough understanding of embodiments of the invention. One skilled in the relevant art will recognize, however, that embodiments of the invention can be practiced without one or more of the specific details, or with other methods, components, materials, etc. In other instances, well-known structures, materials, or operations may not be shown or described in detail.

The invention claimed is:

1. A tool organizer and transport comprising:

a bucket having a bottom and a cylindrical sidewall, the cylindrical sidewall is coupled to the bottom and extends upwardly therefrom, thereby defining an interior space and a top opening;

at least one indicator line, the at least one indicator line extends horizontally about an interior side of the cylindrical sidewall of the bucket;

a storage space located between the indicator line and the bottom of the bucket;

a lid configured to be removably secured to a top side of the bucket; and a tool container insert having a body portion and a flexible handle, the flexible handle includes a first end and a second end, each end of the flexible handle is secured to an opposing sidewall of the body portion;

wherein the tool container insert is configured to be removably received within the interior space of the bucket and not protrude above the top opening thereof.

2. The tool organizer and transport of claim 1, wherein the body portion of the tool container insert comprises:

a bottom having a cylindrical sidewall extending upwardly therefrom, a first interior sidewall, and a second interior sidewall, wherein the first interior sidewall and the second interior sidewall each extend between two oppositely located portions of the cylindrical sidewall;

a first interior pocket located between a first portion of the cylindrical sidewall and the first interior sidewall;

a second interior pocket located between the first interior sidewall the second interior sidewall, a second portion of the cylindrical sidewall and a third portion of the cylindrical sidewall; and a third interior pocket located between a fourth portion of the cylindrical sidewall and the second interior sidewall.

3. The tool organizer and transport of claim 2, wherein the body portion of the tool container insert further comprises an annular rim on a top side of the cylindrical sidewall, a first portion of the annular rim adjacent the first interior pocket is a first color, a second portion and a third portion of the annular rim adjacent the second interior pocket are a second color, and a fourth portion of the annular rim adjacent the third interior pocket is a third color.

4. The tool organizer and transport of claim 2, wherein the handle of the tool container insert extends between the first interior sidewall and the second interior sidewall of the body portion.

5. The tool organizer and transport of claim 2, wherein the bucket further comprises a handle.

6. The tool organizer and transport of claim 2, wherein the body portion of the tool container insert further comprises three pockets positioned about the exterior of the cylindrical sidewall.

7. A method of using the tool organizer and transport of claim 3, the method comprising:

placing a first tool type associated with the first color of the annular rim into the first interior pocket of the tool container insert;

placing a second tool type associated with the second color of the annular rim into the second interior pocket of the tool container insert; and placing a third tool type associated with the third color of the annular rim into the third interior pocket of the tool container insert.

8. The method of claim 7 further comprising:

placing tools into the storage space of the bucket; and resting the tool container insert on top of the tools located in the storage space.

9. A tool container insert comprising:

a body portion and a handle configured to be received within a bucket, the body portion comprises a bottom having a cylindrical sidewall extending upwardly therefrom, a first interior sidewall, a second interior sidewall, a first interior pocket, a second interior pocket, a third interior pocket, and an annular rim on a top side of the cylindrical sidewall;

the first interior sidewall and the second interior sidewall each extend between two oppositely located portions of the cylindrical sidewall of the body portion;

the first interior pocket is located between a first portion of the cylindrical sidewall and the first interior sidewall;

the second interior pocket is located between the first interior sidewall, the second interior sidewall, a second portion of the cylindrical sidewall, and a third portion of the cylindrical sidewall;

the third interior pocket is located between a fourth portion of the cylindrical sidewall and the second interior sidewall; and a first portion of the annular rim adjacent the first interior pocket is a first color, a second portion and a third portion of the annular rim adjacent the second interior pocket are a second color, and a fourth portion of the annular rim adjacent the third interior pocket is a third color.

10. The tool container insert of claim 9, wherein the handle of the tool container insert extends between the first interior sidewall and the second interior sidewall of the body portion.

11. The tool container insert of claim 10, wherein the body portion of the tool container insert further comprises three pockets positioned about the exterior of the cylindrical sidewall.

12. A method of using the tool container insert of claim 9, the method comprising:

placing a first tool type associated with the first color of the annular rim into the first interior pocket of the tool container insert;

placing a second tool type associated with the second color of the annular rim into the second interior pocket of the tool container insert; and placing a third tool type associated with the third color of the annular rim into the third interior pocket of the tool container insert.

* * * * *